US009601291B2

(12) United States Patent
Jang

(10) Patent No.: US 9,601,291 B2
(45) Date of Patent: Mar. 21, 2017

(54) ACTUATOR FOR CIRCUIT BREAKER AND METHOD FOR MANUFACTURING THE SAME

(71) Applicant: LSIS CO., LTD., Anyang-si, Gyeonggi-do (KR)

(72) Inventor: Jun Yong Jang, Seoul (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 14/861,887

(22) Filed: Sep. 22, 2015

(65) Prior Publication Data

US 2016/0093457 A1 Mar. 31, 2016

(30) Foreign Application Priority Data

Sep. 30, 2014 (KR) ..... 10-2014-0131715

(51) Int. Cl.

| | |
|---|---|
| ***H01H 3/00*** | (2006.01) |
| ***H01H 50/18*** | (2006.01) |
| ***H01H 50/36*** | (2006.01) |
| ***H01H 49/00*** | (2006.01) |
| ***H01H 50/42*** | (2006.01) |

(52) U.S. Cl.

CPC ..... *H01H 50/18* (2013.01); *H01H 49/00* (2013.01); *H01H 50/36* (2013.01); *H01H 50/42* (2013.01)

(58) Field of Classification Search

CPC ..... H01H 50/18; H01H 50/20; H01H 50/30; H01H 50/36; H01H 50/56; H01H 49/00; H01H 51/01; H01H 51/2209

USPC ..... 335/185

See application file for complete search history.

(56) References Cited

U.S. PATENT DOCUMENTS

| | | | | |
|---|---|---|---|---|
| 3,211,858 A * | 10/1965 | Juptuer | H01H 49/00 | 335/80 |
| 4,053,858 A * | 10/1977 | Aidn | H01H 50/36 | 335/128 |
| 5,394,127 A * | 2/1995 | Hendel | H01H 50/54 | 335/128 |
| 5,886,601 A * | 3/1999 | Kitamura | H01H 50/54 | 335/128 |
| 5,892,194 A * | 4/1999 | Uotome | H01H 1/34 | 218/68 |
| 6,040,752 A * | 3/2000 | Fisher | H01F 7/1615 | 335/229 |
| 7,157,996 B2 * | 1/2007 | Enomoto | H01H 50/02 | 335/126 |

(Continued)

FOREIGN PATENT DOCUMENTS

| | | |
|---|---|---|
| FR | 2536900 | 6/1984 |
| JP | 6-15385 | 4/1994 |
| KR | 10-2014-0083963 | 7/2014 |

OTHER PUBLICATIONS

European Patent Office Application Serial No. 15186711.6, Search Report dated Feb. 23, 2016, 7 pages.

(Continued)

*Primary Examiner* — Shawki S Ismail
*Assistant Examiner* — Lisa Homza
(74) *Attorney, Agent, or Firm* — Lee, Hong, Degerman, Kang & Waimey PC

(57) ABSTRACT

The present disclosure may fix the second yoke without using an upper cover and a lower cover, thereby having an effect of simplifying the entire structure, and reducing the fabrication cost, and decreasing the fabrication time.

3 Claims, 8 Drawing Sheets

(56) References Cited

U.S. PATENT DOCUMENTS

| | | | | |
|---|---|---|---|---|
| 8,138,863 | B2 * | 3/2012 | Tanaka | H01H 1/54 335/126 |
| 8,138,872 | B2 * | 3/2012 | Yoshihara | H01F 7/1615 335/124 |
| 2004/0027776 | A1 * | 2/2004 | Uotome | H01H 47/06 361/160 |
| 2009/0066450 | A1 * | 3/2009 | Yano | H01H 49/00 335/203 |
| 2009/0237190 | A1 * | 9/2009 | Nyzner | H01H 50/36 335/174 |
| 2009/0322453 | A1 * | 12/2009 | Kawaguchi | H01F 7/1615 335/81 |
| 2011/0221548 | A1 * | 9/2011 | Yoshihara | H01H 51/29 335/185 |
| 2015/0213987 | A1 * | 7/2015 | Sasaki | H01H 51/2209 335/78 |
| 2015/0248959 | A1 * | 9/2015 | Hamelinck | F16C 32/0465 335/229 |
| 2015/0380194 | A1 * | 12/2015 | Lee | H01H 50/041 335/192 |
| 2016/0155592 | A1 * | 6/2016 | Ito | H01H 50/36 335/187 |

OTHER PUBLICATIONS

Korean Intellectual Property Office Application Serial. No. 10-2014-0131715, Office Action dated Feb. 29, 2016, 4 pages.

* cited by examiner

ACTUATOR FOR CIRCUIT BREAKER AND METHOD FOR MANUFACTURING THE SAME

CROSS-REFERENCE TO RELATED APPLICATIONS

Pursuant to 35 U.S.C. §119(a), this application claims the benefit of earlier filing date and right of priority to Korean Patent Application No(s). 10-2014-0131715, filed on Sep. 30, 2014, the contents of which are hereby incorporated by reference herein in its entirety.

BACKGROUND OF THE INVENTION

1. Field of the Invention

The present invention relates to an actuator for a circuit breaker and a fabrication method thereof, and more particularly, to an actuator for a circuit breaker capable of simplifying the structure, reducing the fabrication cost and preventing the performance of a device from being deteriorated due to an external shock, and a fabrication method thereof.

2. Description of the Related Art

As an apparatus used to provide a linear movement in a mechanical apparatus such as a circuit breaker, a refrigerator compressor or the like, and control a switching operation on a portion at which the switching of a contact point is carried out, an actuator can be divided into a mechanical type and an electronic type according to a control method of its switching operation.

An actuator for a circuit breaker in the related art is illustrated in FIG. 1, and a schematic cross-sectional view of a body portion constituting an actuator in the related art is illustrated in FIG. 3, and a schematic view showing the path of a main magnetic path formed within an actuator for a circuit breaker in the related art is illustrated in FIG. 3, and a schematic view showing the path of an auxiliary magnetic path formed within an actuator for a circuit breaker in the related art is illustrated in FIG. 4.

As illustrated in FIGS. 1 through 4, an actuator in the related art may include a body portion 30 in which each constituent element is provided thereinside, an upper cover 10 configured to cover an upper portion of the body portion 30, and a lower cover 20 configured to cover a lower portion of the body portion 30, and the like.

Here, an inside of the body portion 30 may include a wound coil 33, a permanent magnet 37 located adjacent to the coil 33, a stationary core 41 provided between the wound coil 33, a movable core 43 brought into contact with or separated from the stationary core 41, an operating rod 45 allowing the movable core 43 to be brought into contact with or separated from the stationary core 41, an elastic member 40 configured to provide an elastic force to the operating rod 45, a first yoke 31 located in the vicinity of the wound coil 33 to form a main magnetic path, a second yoke 35 configured to form an auxiliary field in a downward direction, a first magnetic force adjustment plate 39 and a second magnetic force adjustment plate 47, and the like.

According to an actuator for a circuit breaker having the foregoing configuration, when a current is applied to each coil 33, a magnetic flux is generated through the coil 33, and a main magnetic path 50 is formed through the first yoke 31, the stationary core 41 and the movable core 43 surrounding the coil 33 while at the same time forming an auxiliary magnetic path 60 through the second yoke 35 or the like, and a magnetic force is generated between the stationary core 41 and the movable core 43 through the main magnetic path 50 and auxiliary magnetic path 60, thereby allowing the movable core 43 to be brought into contact with the stationary core 41.

Furthermore, when the current is blocked, the magnetic force disappears, and the movable core 43 brought into contact with the stationary core 41 receives an elastic restoring force through the elastic member 40 thereby allowing the movable core 43 to be separated from the stationary core 41.

On the other hand, a magnetic strength of the main magnetic path and auxiliary magnetic path is controlled through the first magnetic force adjustment plate 39 and the second magnetic force adjustment plate 47.

However, an actuator for a circuit breaker in the related art having the foregoing configuration may use the upper cover 10 and lower cover 20 to fix the second yoke 35 for forming the auxiliary magnetic path 60, and thus has a problem in which the second yoke 35 cannot be securely fixed.

Furthermore, the upper cover 10 and lower cover 20 may be used therein, and thus has a problem of increasing the volume of the actuator as well as increasing the fabrication cost and increasing a time consumed for fabrication.

Furthermore, since the second yoke 35 is not securely fixed, the second yoke 35 may be shaken or the location of the second yoke 35 may vary while using the actuator to change a magnetic force delivered to the stationary core 41 and movable core 43 through the auxiliary magnetic path 60, and thus has a problem in which the stationary core 41 and movable core 43 are separated from each other in a conducting state.

SUMMARY OF THE INVENTION

The present invention is contrived to solve the foregoing problem, and an aspect of the present invention is to provide an actuator for a circuit breaker capable of simplifying the structure, reducing the fabrication cost and preventing the performance of a device from being deteriorated due to an external shock, and a fabrication method thereof.

An object of the foregoing present disclosure may be accomplished by providing an actuator for a circuit breaker including a frame, a coil provided at both inner sides of the frame, a permanent magnet disposed adjacent to the coil, a first yoke located to surround the coil to form a main magnetic path, and a second yoke provided at a lower side of the first yoke to form an auxiliary magnetic path, wherein fitting portions are provided at both ends of the second yoke, and fitting holes are formed at both upper sides of the first yoke to fit the fitting portions thereinto, and engaging protrusions are formed at both upper sides of the fitting holes to closely fix the fitting portions to the fitting holes in an inward direction.

Furthermore, an upper surface of the engaging protrusion may be formed to be inclined downward as being positioned in an inward direction of the fitting hole.

Furthermore, a stationary core, a movable core brought into contact with or separated from the stationary core, and an operating rod configured to move the movable core may be provided within the coil, and the stationary core may be formed with a first elastic member accommodating portion and a first operating rod moving hole configured to move the operating rod, and the movable core may be formed with a second elastic member accommodating portion and a second operating rod moving hole configured to move the operating rod, and an elastic member may be provided in the first elastic member accommodating portion and the second elastic member accommodating portion to provide an elastic force to the movable core.

Furthermore, a width of the first elastic member accommodating portion may be formed to be larger than that of the first operating rod moving hole to form a first step between the first elastic member accommodating portion and the first operating rod moving hole, and a width of the second elastic member accommodating portion may be formed to be larger than that of the first operating rod moving hole to form a second step between the second elastic member accommodating portion and the second operating rod moving hole, and a movement adjuster closely adhered to the second step may be formed on the operating rod along an outer circumferential surface thereof, and when an elastic force is provided to the operating rod in a state that the elastic member is inserted into the first elastic member accommodating portion and the second elastic member accommodating portion, the movement adjuster may press the movable core to move the movable core in an opposite direction to the stationary core.

Another object of the foregoing present disclosure may be accomplished by providing a fabrication method of an actuator for a circuit breaker according to claim 1, and the method may include (a) fixing an actuator with a fixing jig; (b) closely adhering a second yoke to a first yoke and then applying a load to the second yoke to fix the second yoke to the first yoke; (c) measuring a contact strength between the stationary core and the movable core and then adjusting the position of the second yoke; and (d) forming an engaging protrusion on the first yoke to fix the second yoke to the first yoke.

Furthermore, a first magnetic force adjustment plate located adjacent to the permanent magnet and a second magnetic force adjustment plate located to be closely adhered to an inner lateral surface of the second yoke may be provided within the actuator.

As described above, an actuator for a circuit breaker according to the present disclosure and a fabrication method thereof may fix the second yoke without using an upper cover and a lower cover, thereby having an effect of simplifying the entire structure, and reducing the fabrication cost, and decreasing the fabrication time.

Furthermore, a fitting hole and an engaging protrusion may be formed on an upper portion of the first yoke, and the second yoke may be securely fixed to the first yoke through the fitting hole and engaging protrusion to prevent the second yoke from being shaken during the operation of the actuator or the location thereof from being changed, thereby having an effect of preventing the stationary core and movable core from being separated from each other in a conducting state since a magnetic force generated between the stationary core and the movable core is changed due to a location change of the second yoke.

In addition, since the fitting hole is formed and then the second yoke is closely adhered to the fitting hole and then the engaging protrusion is formed, the location of the second yoke may be adjusted to allow a contact strength between the stationary core and the movable core to be above an elastic restoring force of the spring when the contact strength is measured, thereby increasing the completeness of the product to have an effect of preventing the stationary core and the movable core from being malfunctioned in a conducting or blocking state.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Hereinafter, an actuator for a circuit breaker according to an embodiment of the present disclosure will be described in detail with reference to the accompanying drawings.

Figure 1:
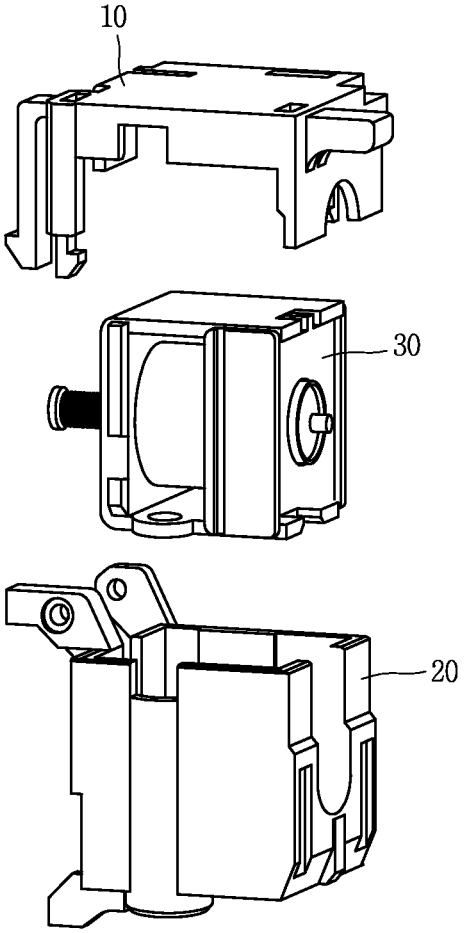
FIG. 1 RELATED ART
FIG. 1 is an exploded perspective view illustrating an actuator for a circuit breaker in the related art.
Figure 2:
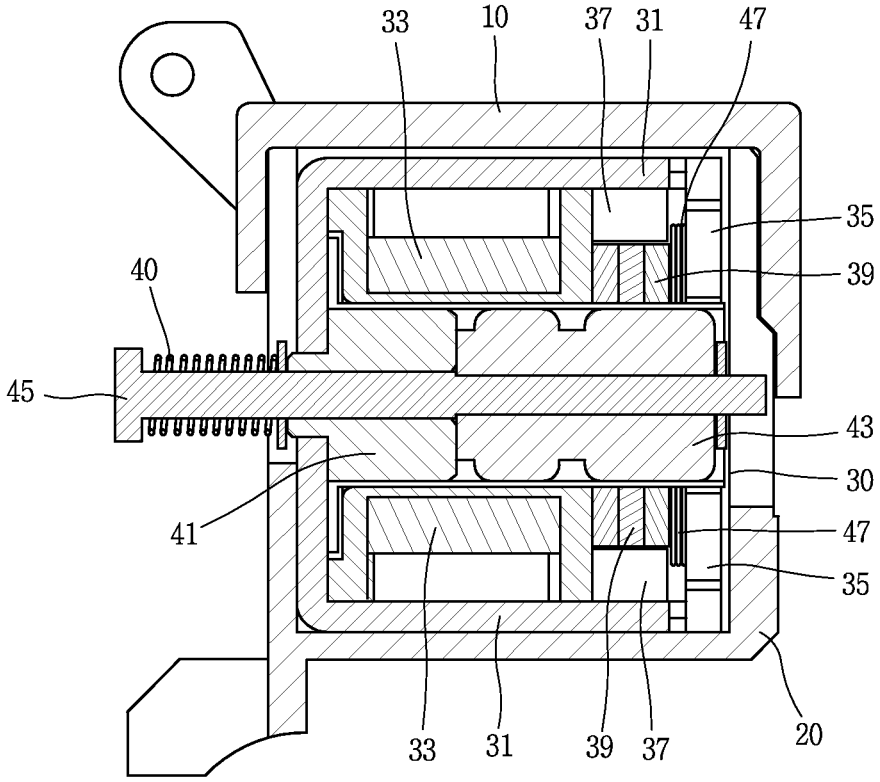
FIG. 2 RELATED ART
FIG. 2 is a cross-sectional view illustrating an actuator for a circuit breaker in the related art.
Figure 3:
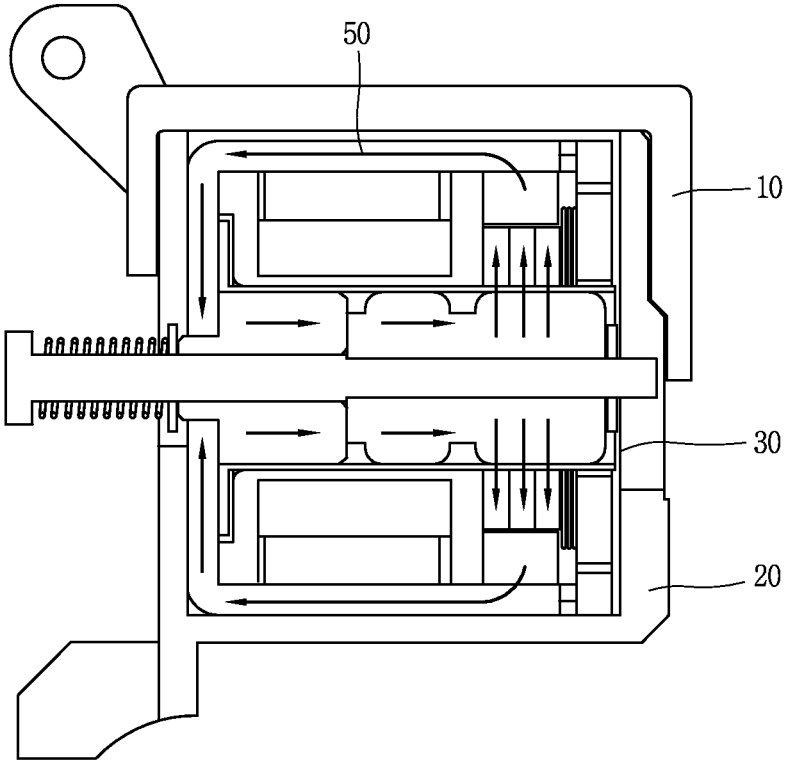
FIG. 3 RELATED ART
FIG. 3 is a schematic view illustrating the path of a main magnetic field formed within an actuator for a circuit breaker in the related art.
Figure 4:
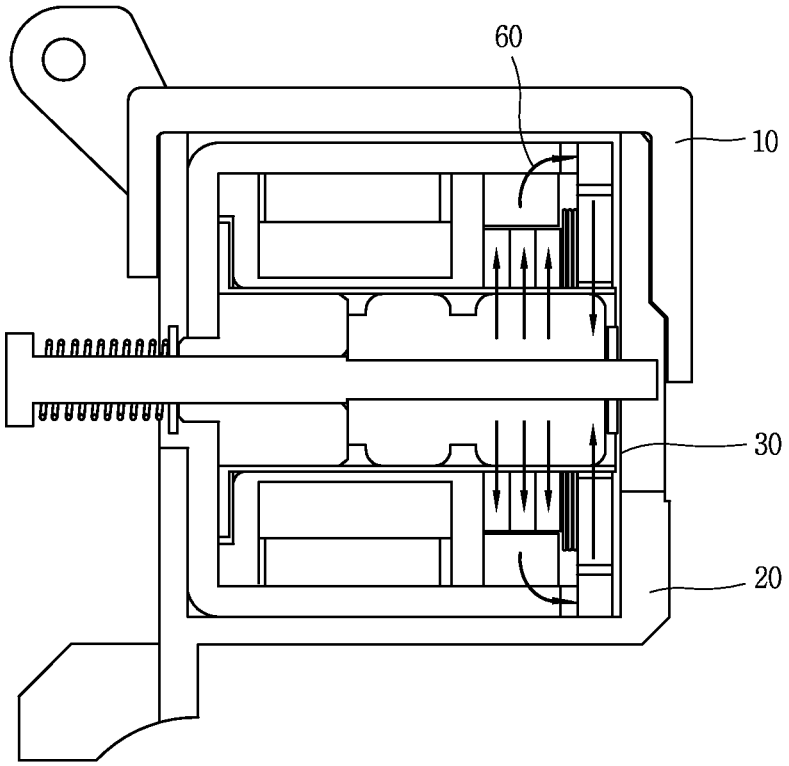
FIG. 4 RELATED ART
FIG. 4 is a schematic view illustrating the path of an auxiliary magnetic field formed within an actuator for a circuit breaker in the related art.
Figure 5:
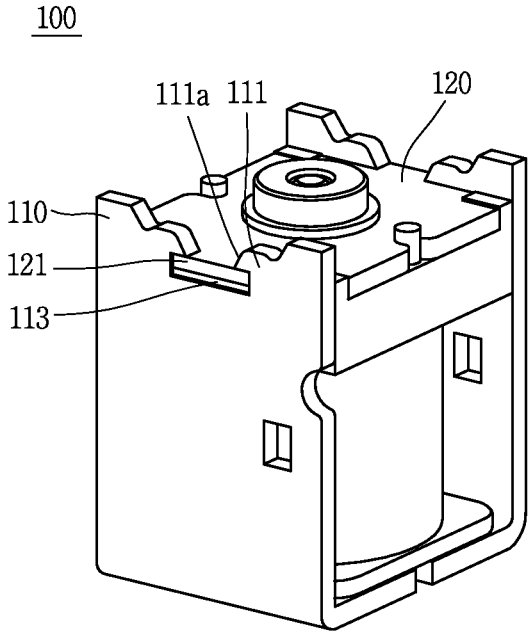
FIG. 5 is a perspective view illustrating an actuator for a circuit breaker according to the present disclosure.
Figure 6:
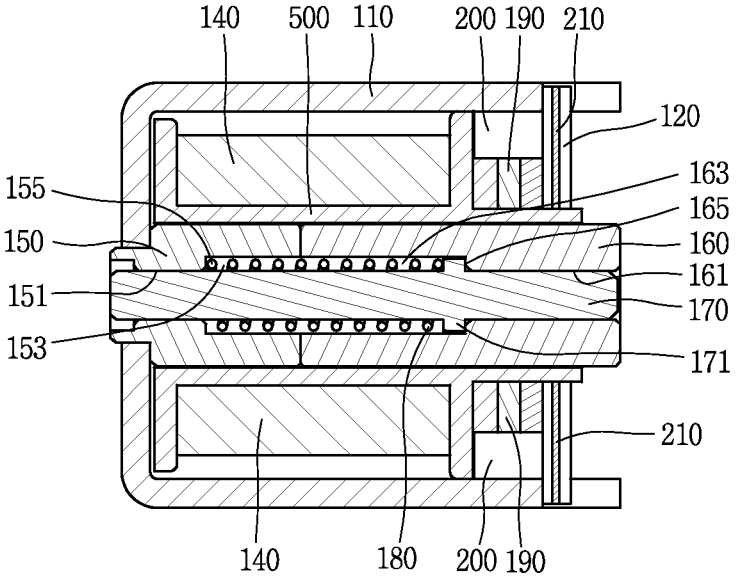
FIG. 6 is a cross-sectional view illustrating an actuator for a circuit breaker according to the present disclosure.
Figure 7:
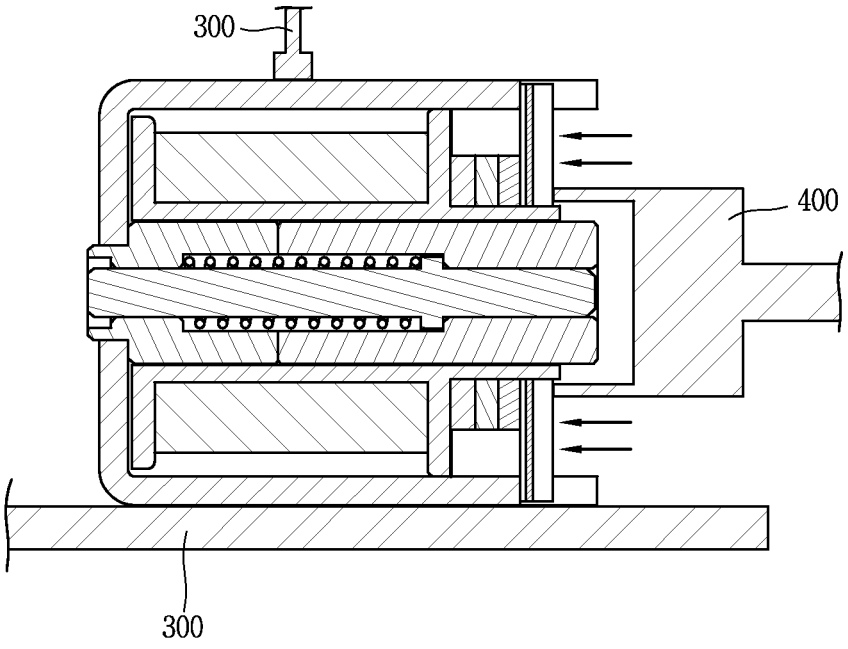
FIG. 7 is a schematic view illustrating a configuration in which an actuator for a circuit breaker according to the present disclosure is fixed to a fixing jig.
Figure 8:
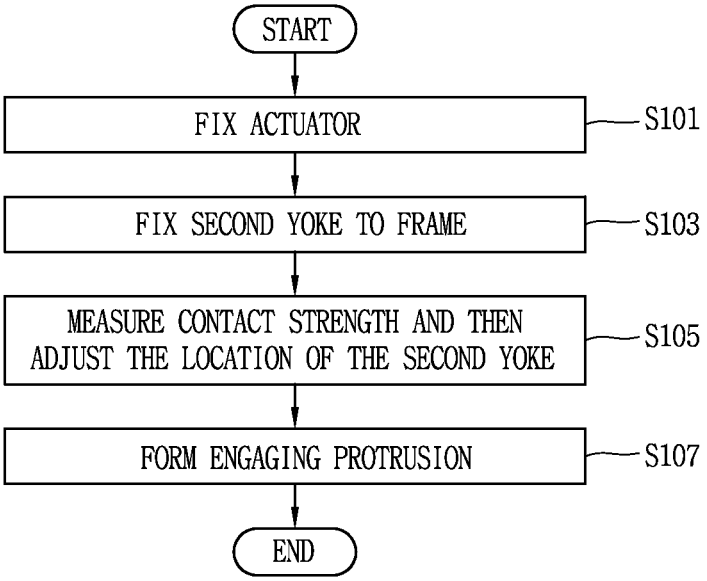
FIG. 8 is a flow chart illustrating a fabrication process of an actuator for a circuit breaker according to the present disclosure.

FIG. 5 is a perspective view illustrating an actuator for a circuit breaker according to the present disclosure, and FIG. 6 is a cross-sectional view illustrating an actuator for a circuit breaker according to the present disclosure, and FIG. 7 is a schematic view illustrating a configuration in which an actuator for a circuit breaker according to the present disclosure is fixed to a fixing jig, and FIG. 8 is a flow chart illustrating a fabrication process of an actuator for a circuit breaker according to the present disclosure.

As illustrated in FIGS. 5 and 6, the actuator 100 for a circuit breaker according to the present disclosure may include a frame 500, a coil 140 wound within the frame 140, a permanent magnet 200 disposed adjacent to the coil 140, a first yoke 110 formed to surround the coil 140 to form a main magnetic path, and a second yoke 120 located at a lower side of the first yoke 110 to form an auxiliary magnetic path, a stationary core 150 provided within the coil 140, a movable core 160 brought into contact with or separated from the stationary core 150, an operating rod 170 configured to move the movable core 160, a first magnetic force adjustment plate 190 and a second magnetic force adjustment plate 210 located between the first yoke 110 and the second yoke 120 to adjust a magnetic strength formed through the main magnetic path.

The frame 500 may include each constituent element therewithin, and the coil 140 may be provided at both inner sides of the frame 500 to generate a magnetic flux when a current is applied thereto, thereby generating a magnetic force between the stationary core 150 and the movable core 160 to be brought into contact with each other.

The permanent magnet 200 may enhance the generated magnetic flux to efficiently carry out contact between the stationary core 150 and the movable core 160.

The first yoke 110 has a U-shape and forms a main magnetic path along with the stationary core 150 and the movable core 160.

The second yoke is formed in a plate shape, and located at a lower side of the first yoke 110 to form an auxiliary magnetic path.

Here, fitting holes 113 are formed at both upper sides of the first yoke 110, and fitting portions 121 are formed at both ends of the second yoke 120, and the fitting portions 121 are fitted into the fitting holes 113, thereby allowing the second yoke 120 to be connected to the first yoke 110.

Furthermore, engaging protrusions 111 in which an upper surface 111*a* thereof is inclined downward as being positioned in an inward direction of the fitting holes 113 are formed at both upper sides of the fitting holes 113, and the fitting portions 121 are fitted into the fitting holes 113 in a state that a lower surface of the engaging protrusions 111 is brought into contact with an upper surface of the second yoke 120, and thus the second yoke 120 is more securely fixed to the first yoke 110 as well as the upper cover 10 and the lower cover 20 are not additionally required to fix the second yoke 120, thereby simplifying the entire structure of the actuator 100, reducing the fabrication time as well as greatly decreasing the fabrication cost.

On the other hand, the stationary core 150 is located within the coil 140, and formed to have a circular cross section, so as to be brought into contact with or separated from the movable core 160.

Furthermore, a first operating rod moving hole 151 is formed on the stationary core 150 to move in a state that the operating rod 170 is inserted thereinto, and a first elastic member accommodating portion 153 into which an elastic member 180 such as a spring is inserted is formed thereon to provide an elastic force to the operating rod 170.

Here, a width of the first elastic member accommodating portion 153 is formed to be larger than that of the first operating rod moving hole 151 to form a first step 155 between the first elastic member accommodating portion 153 and the first operating rod moving hole 151.

The movable core 160 is located within the coil 140, and formed to have a circular cross section, so as to be brought into contact with or separated from the stationary core 150 through the movement of the operating rod 170 or a magnetic force.

Furthermore, a second operating rod moving hole 161 is formed on the movable core 160 to move in a state that the operating rod 170 is inserted thereinto, and a second elastic member accommodating portion 163 into which an elastic member 180 such as a spring is inserted is formed thereon to provide an elastic force to the operating rod 170.

Here, a width of the second elastic member accommodating portion 163 is formed to be larger than that of the second operating rod moving hole 161 to form a second step 165 between the second elastic member accommodating portion 163 and the second operating rod moving hole 161.

Accordingly, the elastic member 180 is located such that an end thereof is brought into contact with the first step 155 and the other end thereof is brought into contact with a movement adjuster 171 formed on the operating rod 170 in a state being inserted into the first elastic member accommodating portion 153 and the second elastic member accommodating portion 163, thereby providing an elastic force to the movable core 160.

The operating rod 170 receives an elastic force of the elastic member 180 such as a spring in a state of being inserted into the first operating rod moving hole 151 and the second operating rod moving hole 161 to move the movable core 160 in an opposite direction to the stationary core 150.

Here, the movement adjuster 171 is formed on an outer circumferential surface of the operating rod 170 such that an end of the movement adjuster 171 is brought into contact with the other end of the elastic member 180, and the other end of the movement adjuster 171 is brought into contact with the second step 165, thereby pressing the movable core 160 in an opposite direction to the stationary core 150 through an elastic restoring force of the elastic member 180.

On the other hand, a magnetic strength formed on the main magnetic path and auxiliary magnetic path is adjusted through the first magnetic force adjustment plate 190 and the second magnetic force adjustment plate 210, and if a magnetic strength generated through a current applied to the coil 140 is "A", and a magnetic strength due to the main magnetic path is "B", and a magnetic strength due to the auxiliary magnetic path is "C", then the relationship of A=B+C is established, and a magnetic strength (A) due to the main magnetic path is adjusted through the first magnetic force adjustment plate 190 and a magnetic strength due to the auxiliary magnetic path is adjusted through the second magnetic force adjustment plate 210.

In other words, in case of the first magnetic force adjustment plate 190, the magnetic strength (A) due to the main magnetic path may be enhanced by increasing the thickness and number thereof or using a magnetic body, thereby enhancing a contact strength between the stationary core 150 and the movable core 160.

In case of the second magnetic force adjustment plate 210, when it is made of a non-magnetic body, the auxiliary magnetic path formed through the second magnetic force adjustment plate 210 is formed through the non-magnetic body, and thus an effect of the auxiliary magnetic path on the main magnetic path is reduced to enhance a contact strength between the stationary core 150 and the movable core 160.

Furthermore, when the second magnetic force adjustment plate 210 is formed with a magnetic body, a magnetic strength (B) due to the auxiliary magnetic path is enhanced to enhance a contact strength between the stationary core 150 and the movable core 160.

Due to the foregoing configuration, when a current is applied to the coil 140 of the actuator 100 for a circuit breaker, a magnetic flux is generated, and thus a magnetic force is generated between the stationary core 150 and the movable core 160, thereby allowing the movable core 160 to be brought into contact with the stationary core 150 while pressing the elastic member 180 such as a spring in a direction of the stationary core 150. Here, the movable core 160 is in a state of receiving an elastic restoring force in an opposite direction to the stationary core 150 due to the spring.

On the other hand, when a current applied to the coil 140 is suspended, a magnetic flux is not generated, and thus a magnetic force between the stationary core 150 and the movable core 160 disappears, thereby allowing the movable core 160 to be separated from the stationary core 150 while moving in an opposite direction of the stationary core 150 due to an elastic restoring force of the elastic member 180.

A fabrication process of the actuator 100 for a circuit breaker according to an embodiment of the present disclosure will be described in detail with reference to FIGS. 6 through 8.

First, the actuator 100 in which the second yoke 120 is not provided is fixed to a fixing jig 300 located in a vertical direction in a state that each constituent element such as the coil 140, permanent magnet 200 or the like is provided in the frame 500 (S101).

Then, the second yoke 120 is closely adhered to the first yoke 110, and then a load is applied to the second yoke 120 using a load application member 400, thereby allowing the second yoke 120 to be fixed to the first yoke 110 and frame 500 (S103).

Then, a contact strength (retaining force) due to a magnetic force of the stationary core 150 and the movable core 160 is measured, and the location of the second yoke 120 is adjusted when the measured contact strength is not greater than an elastic restoring force of the elastic member 180 (S105).

At this time, as a separation distance between the second yoke 120 and the first yoke 110 increases, the extent of eliminating a magnetic force formed on the main magnetic path due to the first yoke 110 decreases by a magnetic force formed on the auxiliary magnetic path due to the second yoke 120, thereby increasing a contact strength between the stationary core 150 and the movable core 160.

For example, when the measured contact strength between the stationary core 150 and the movable core 160 is less than an elastic restoring force applied to the movable core 160 through the elastic member 180, the stationary core 150 is not brought into contact with the movable core 160 even when a current is applied thereto, and thus the location of the second yoke 120 fixed through the load application member 400 is adjusted to be further away from the first yoke 110 to some extent, so as to increase a contact strength between the stationary core 150 and the movable core 160, thereby efficiently performing contact and separation between the stationary core 150 and the movable core 160 according to whether or not a current is applied thereto.

Subsequent to adjusting the location of the second yoke 120, the engaging protrusion 111 is formed to finish the actuator 100 (S107).

In case of the present disclosure, the actuator 100 for a circuit breaker is fabricated through the foregoing process to adjust the location of the second yoke 120 during the fabrication process so as to appropriately adjust a contact strength between the stationary core 150 and the movable core 160, thereby greatly enhancing the productivity of the actuator 100.

While the present invention has been described in terms of its preferred embodiments, various alternatives, modifications and equivalents will be apparent to those skilled in the art, and it is clear that the invention is applicable in the same manner by appropriately modifying the above embodiments. Accordingly, the disclosure is not intended to limit the scope of the invention as defined by the limitation of the following claims.

What is claimed is:

1. An actuator for a circuit breaker comprising:

a frame;

a coil provided at both inner sides of the frame;

a permanent magnet disposed adjacent to the coil;

a first yoke provided to surround the coil to form a main magnetic path; and a second yoke provided at a lower side of the first yoke to form an auxiliary magnetic path, wherein:

fitting portions are provided at both ends of the second yoke;

fitting holes are formed at both upper sides of the first yoke and configured to accommodate the fitting portions;

engaging protrusions are formed at both upper sides of the fitting holes to secure the fitting portions to the fitting holes; and an upper surface of each of the engaging protrusions is formed to be inclined downward and in an inward direction toward the fitting hole.

2. An actuator for a circuit breaker, comprising:

a coil; and a stationary core, a movable core configured to be brought into contact with or separated from the stationary core, and an operating rod configured to move the movable core provided within the coil, wherein:

the stationary core is formed with a first elastic member accommodating portion and a first operating rod moving hole configured to accommodate the operating rod;

the movable core is formed with a second elastic member accommodating portion and a second operating rod moving hole configured to move the operating rod;

an elastic member is provided in the first elastic member accommodating portion and the second elastic member accommodating portion to provide an elastic force to the movable core.

3. The actuator for a circuit breaker according to claim 2, wherein:

a width of the first elastic member accommodating portion is larger than a width of the first operating rod moving hole to form a first step between the first elastic member accommodating portion and the first operating rod moving hole;

a width of the second elastic member accommodating portion is larger than a width of the second operating rod moving hole to form a second step between the second elastic member accommodating portion and the second operating rod moving hole;

a movement adjuster disposed on an outer circumferential surface of the operating rod proximate to the second step; and the movement adjuster is configured to move the movable core in a direction away from the stationary core when an elastic force is provided to the operating rod by the elastic member provided within the first elastic member accommodating portion and the second elastic member accommodating portion.

* * * * *